US008430678B2

(12) United States Patent
Yeh

(10) Patent No.: US 8,430,678 B2
(45) Date of Patent: Apr. 30, 2013

(54) SOCKET USING CONTACT TO HOLD SOLDER BALL AND METHOD OF MAKING THE SAME

(75) Inventor: Cheng-Chi Yeh, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 51 days.

(21) Appl. No.: 13/231,979

(22) Filed: Sep. 14, 2011

(65) Prior Publication Data

US 2012/0064775 A1 Mar. 15, 2012

(30) Foreign Application Priority Data

Sep. 14, 2010 (TW) ..... 099217730 U

(51) Int. Cl.
*H01R 12/00* (2006.01)

(52) U.S. Cl.
USPC ..... 439/83

(58) Field of Classification Search ..... 439/83, 439/876
See application file for complete search history.

(56) References Cited

U.S. PATENT DOCUMENTS

| | | | | |
|---|---|---|---|---|
| 5,413,970 | A * | 5/1995 | Russell | 29/827 |
| 6,139,336 | A | 10/2000 | Olson | |
| 6,575,763 | B1 * | 6/2003 | Choy | 439/64 |
| 7,195,498 | B1 * | 3/2007 | Wang et al. | 439/83 |
| 7,462,065 | B1 | 12/2008 | Zhao | |
| 7,540,785 | B1 | 6/2009 | Zhao | |
| 7,717,728 | B1 * | 5/2010 | Wang | 439/328 |
| 7,938,664 | B2 * | 5/2011 | Hsieh et al. | 439/326 |
| 8,052,436 | B1 * | 11/2011 | Ju | 439/83 |

* cited by examiner

*Primary Examiner* — Phuong Dinh
(74) *Attorney, Agent, or Firm* — Wei Te Chung; Ming-Chieh Chang

(57) ABSTRACT

A socket (100) comprises a base (1), a plurality of contacts (4, 3) respectively disposed therein and a plurality of solder balls (5) each connecting to the corresponding contacts (4, 3), the base comprises a central slot (1041) for receiving a module and a plurality of passageways (1031, 1022) at two sides of the central slot (4041) to receive the contacts (4, 3), respectively, the contact (4, 3) comprises a body portion (41, 31) positioned in the base (1), a contact portion (431, 331) extending from the body portion (41, 31) into the central slot (1041) and a tail (42, 32) extending from the body portion (41, 31), the solder balls (5) are positioned by the tails (421, 321) of the contacts (4, 3).

8 Claims, 12 Drawing Sheets

SOCKET USING CONTACT TO HOLD SOLDER BALL AND METHOD OF MAKING THE SAME

BACKGROUND OF THE INVENTION

1. Field of the Invention

The present invention relates to a socket and method of making the same, and particularly to a SO DIMM socket with contact having a hook extending curvedly to hold solder ball.

2. Description of Related Art

A typical SO DIMM (Small Outline Dual In-line Memory Module) socket be soldered to a printed circuit board is described in U.S. Pat. No. 6,575,763, issued to Choy on Jun. 10, 2003. The connector comprises a housing, a plurality of contacts received therein and a plurality of solder balls attached to the contacts respectively. The solder ball is soldered to the tail of a contact and be soldered to the printed circuit board.

When conducting a soldering process, there is dilemma. At one hand, it is requested that the tail of the contact expresses solderable property, i.e. the solder ball can be readily and easily attached thereto. If the solder joint is not properly formed between the tail and the solder ball, defective interconnection or so called cold-joint will encounter. Reworking process will always be needed to correct this problem. On the other hand, because of this solderable property, the solder ball tends to flow upward or wick along an external surface of the tail. Once the solder flows and wicks upwardly along the surface resulted from the capillary force, the overall characteristic of the contact terminal will be changed or negatively modified. For example, when the contact is designed, intended normal force, deflection, etc have been carefully calculated so as to meet the field requirements. Once the solder flows and wicks upward to cover the contact, the characteristic of the contact will be altered, and the normal force and other properties will be altered accordingly.

Hence, it is desirable to provide an improved socket to overcome the aforementioned disadvantages.

SUMMARY OF THE INVENTION

Accordingly, an object of the present invention is to provide a socket use the contact to hold the solder ball with no fuse operation.

According to one aspect of the present invention, a socket comprises a base, a plurality of contacts disposed in the base and a plurality of solder balls each connecting to the corresponding contact, the base comprises a central slot for receiving a module and a plurality of passageways at two sides of the central slot to receive the contacts, respectively, the contact comprise a body portion positioned in the base, a contact portion extending from the body portion into the central slot and a tail extending from the body portion, the solder balls are positioned by the tails of the contacts.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
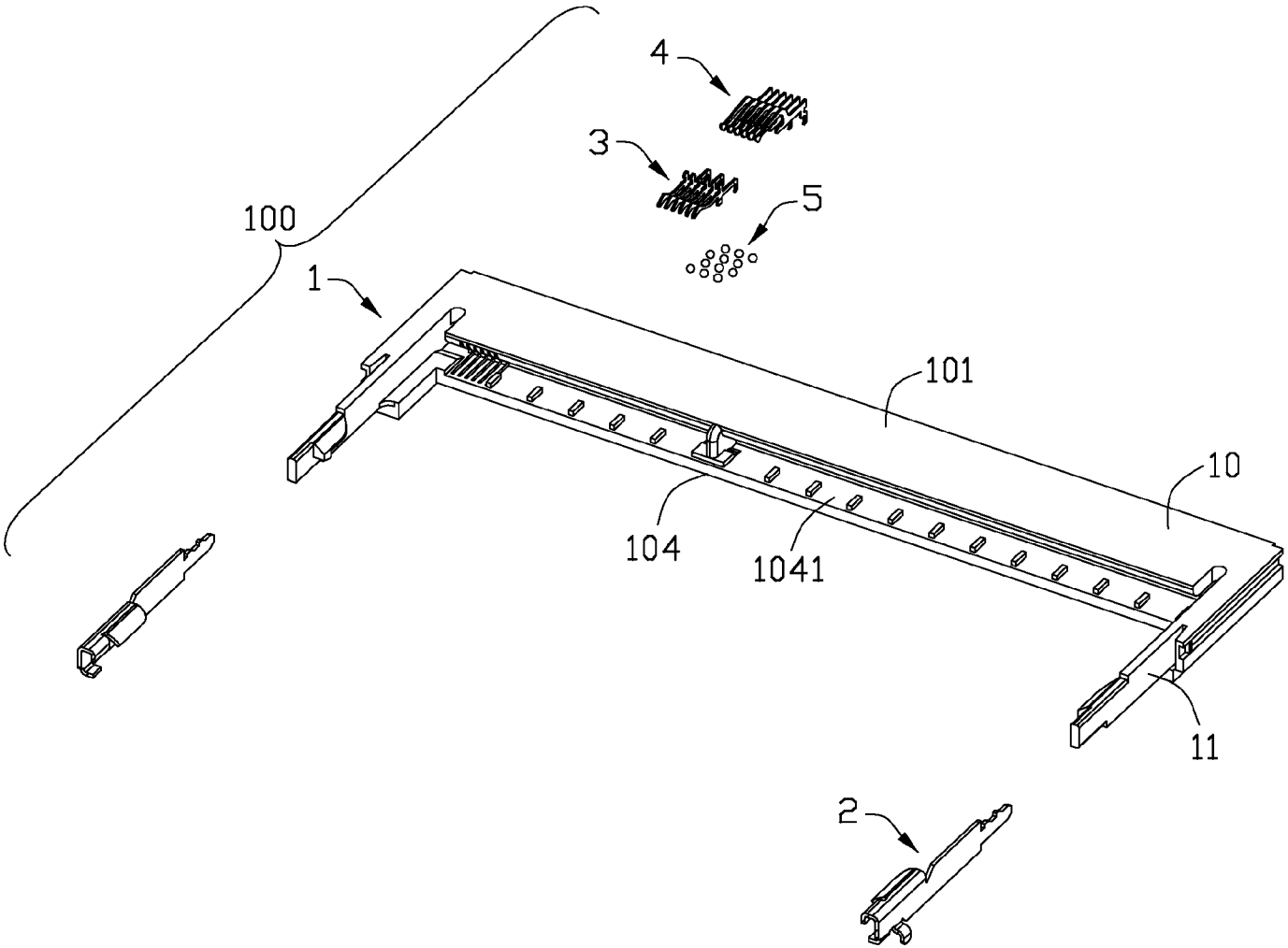
FIG. 1 is an exploded, perspective view of the socket of the present invention.
Figure 11:
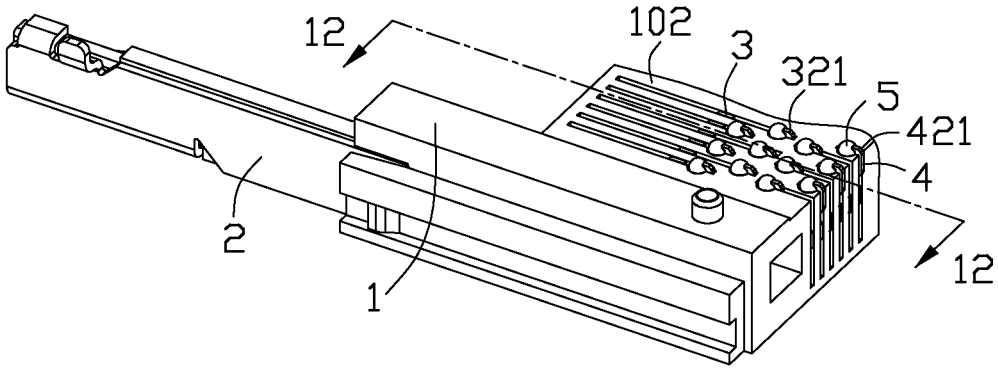
FIG. 11 is an assembled view of socket shown in FIG. 1.
Figure 12:
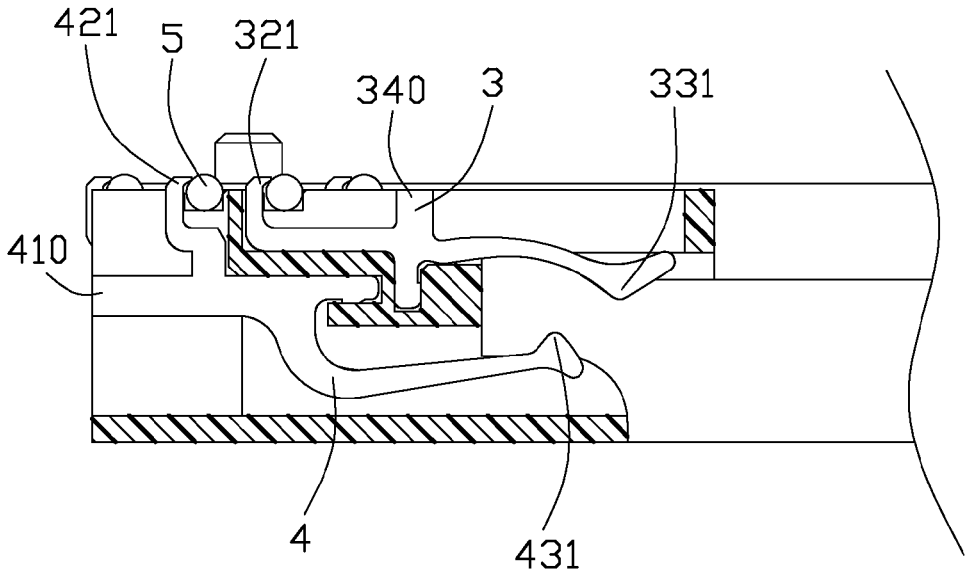
FIG. 12 is a cross-sectional view of the socket shown in FIG. 11 along line 12-12.

Referring to FIG. 1 and FIG. 11, a socket 100 in accordance to a preferred embodiment of the present invention comprises an elongate base 1, two rows of upper contacts 4 and two rows of lower contacts 3 received in the base 1, a metal ear 2 assembled to the base 1 and a plurality of solder balls 5 assembled to the base 1 and each hooked by the upper contact 4 or the lower contact 3.

Figure 4:
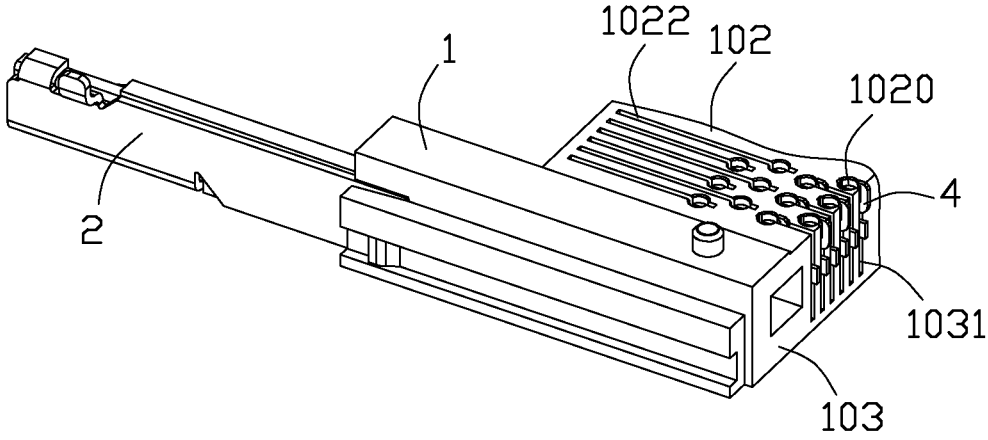
FIG. 4 shows the upper contacts are assembled to the base and located in the original state.
Figure 5:
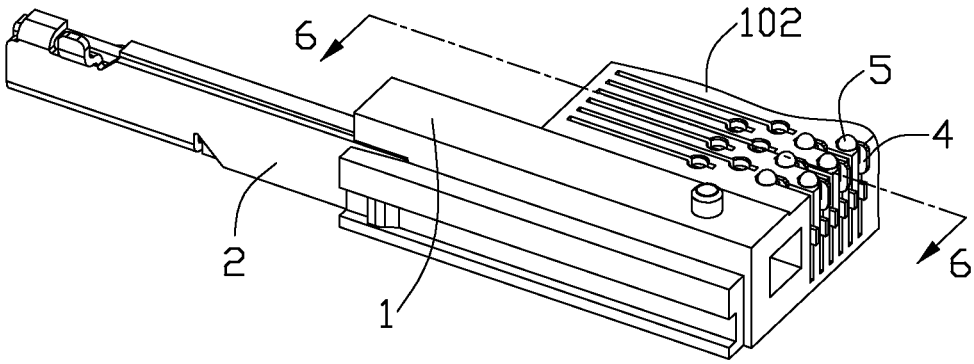
FIG. 5 shows the solder balls are assembled between the base and the upper contacts.
Figure 6:
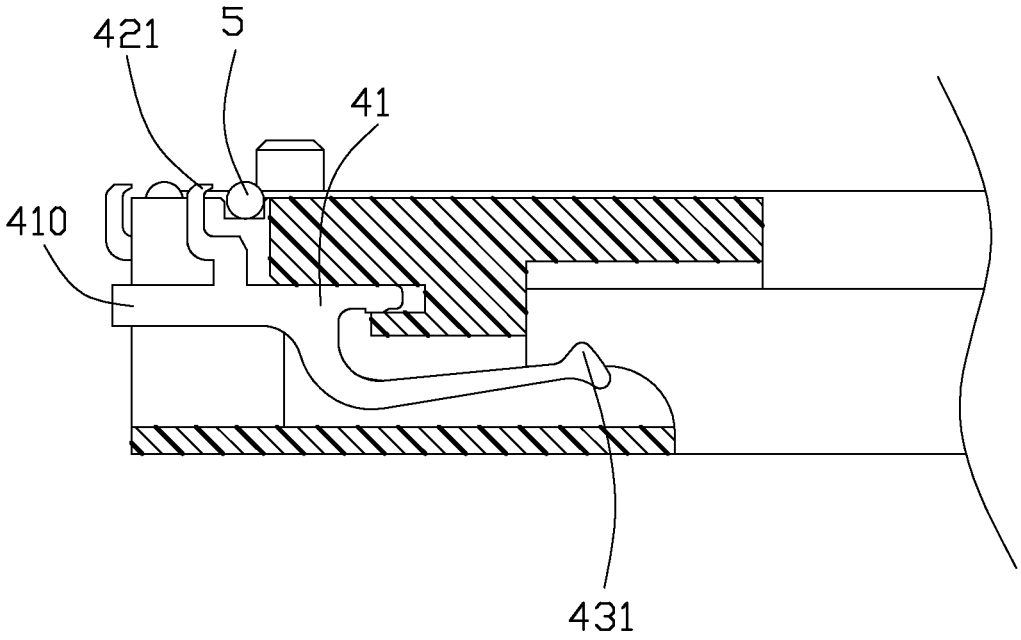
FIG. 6 is a cross-sectional view of the socket shown in FIG. 5 along line 6-6.
Figure 7:
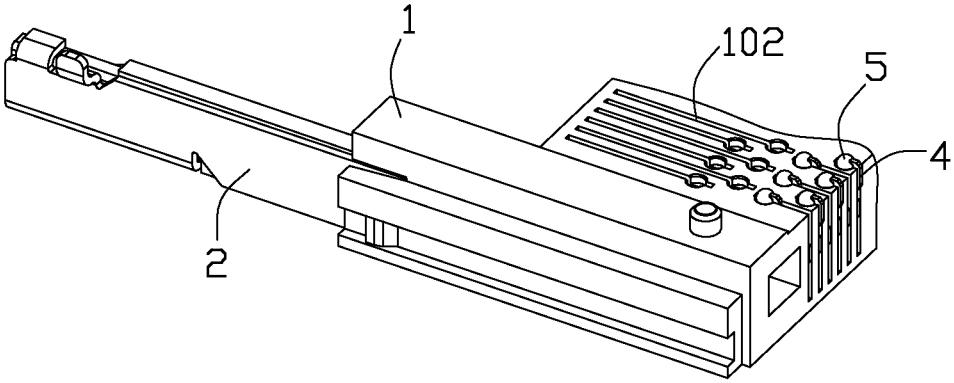
FIG. 7 shows the solder balls are holding by the upper contacts.
Figure 8:
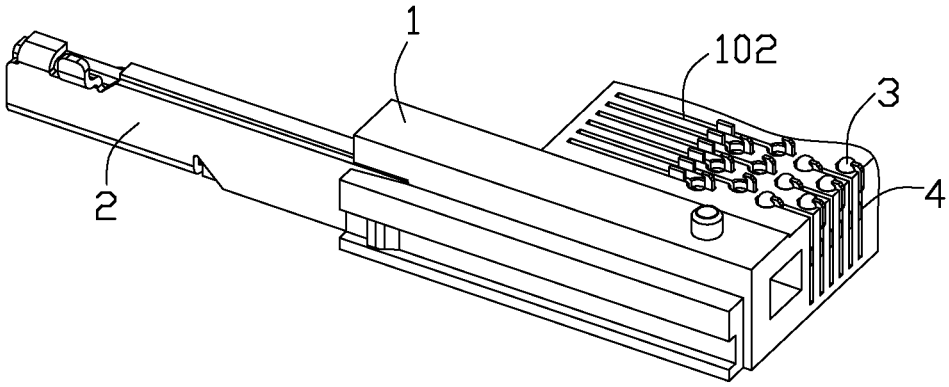
FIG. 8 shows the lower contacts are assembled to the base and located in the original state.
Figure 9:
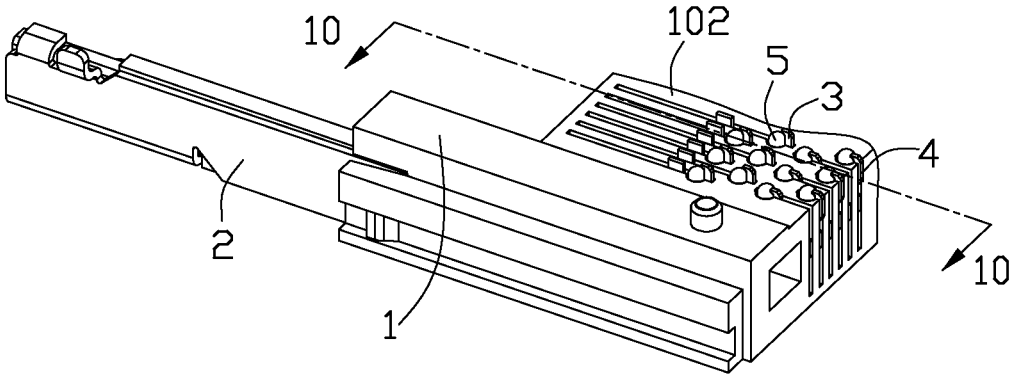
FIG. 9 shows the solder balls are assembled between the base and the lower contacts.
Figure 10:
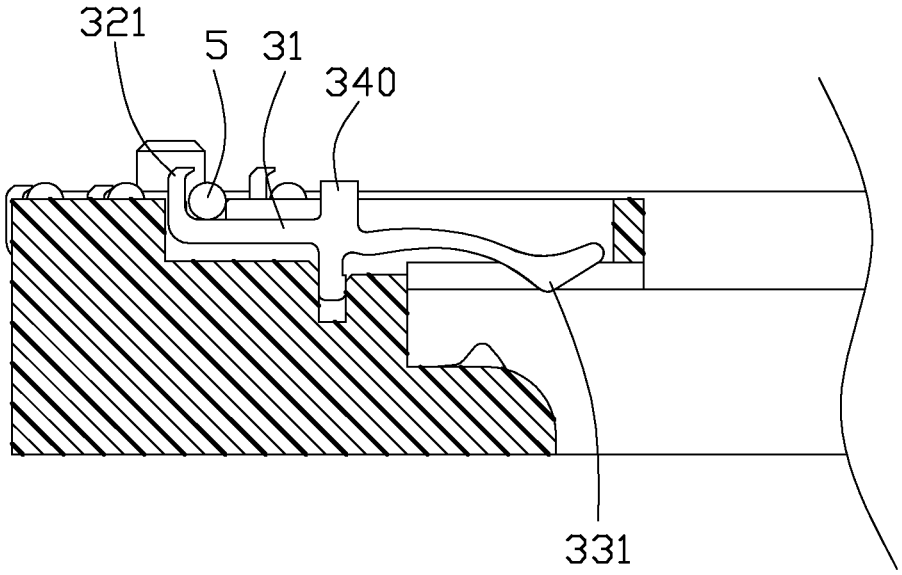
FIG. 10 is a cross-sectional view of the socket shown in FIG. 9 along line 10-10.

Referring to FIG. 1 and FIG. 4, the base 1 includes main body 10 and a pair of latches 11 extending from two ends of the main body 10. The body 10 comprises an upper surface 101, a bottom surface 102 opposite to the upper surface 101, and a back surface 103 connecting the upper surface 101 and the bottom surface 102 and a front surface 104 opposite to the back surface 103. The body 10 comprises a central slot 1041 recessed from the front surface 104 to the interior of the body 10 for receiving a module (not shown) therein. The body 10 also comprises a plurality of upper passageways 1031 penetrating from the back surface 103 to the central slot 1041, a plurality of lower passageways 1022 penetrate from the bottom surface 102 to the slot 1041 and a plurality of recesses 1020 recessed from the bottom surface 102 to the interior of the body 10. Each upper passageway 1031 and lower passageway 1022 is corresponding to a recess 1020 and is communicated with the recess 1020. The recesses 1020 are set to four rows corresponding to the upper passageway 1031 and the lower passageway 1022, and are staggered in different rows. The metal ear 2 is assembled to the latch 11 to strengthen the latch 11.

Figure 2:
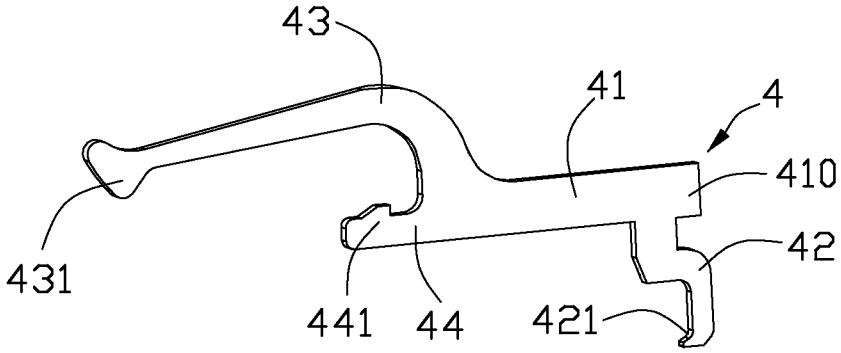
FIG. 2 is an isometric view of the upper contact shown in FIG. 1.
Figure 3:
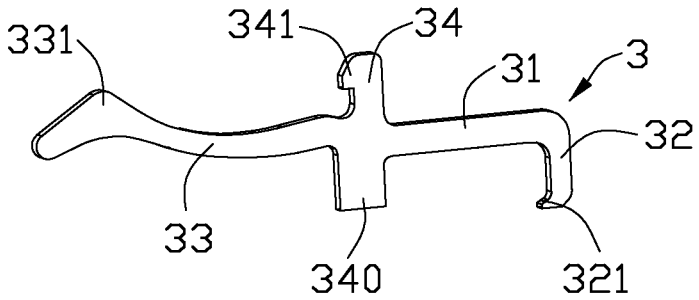
FIG. 3 is an isometric view of the lower contact shown in FIG. 1.

Referring to FIGS. 2-3, the upper contacts 4 are received in the upper passageways 1031 and the lower contacts 3 are received in the lower passageways 1022 to electrically engage with the module assembled in the central slot 1041. The upper contact 4 comprises a plate body portion 41, a retention portion 44 extending forwardly from the body portion 41, a spring portion 43 extending upwardly and forwardly from the body portion 41, a tail 42 extending vertically and downwardly from the body portion 41 and a hook 421 extending forwardly from the tail 42. Then body portion 41 comprises a push portion 410 at one end of the body portion 41. The retention portion 44 comprises a first barb 441. The spring portion 43 comprises a contact portion 431 at a free end thereof The lower contact 3 comprises a plate body portion 31, a retention portion 34 extending upwardly from the body portion 31, a spring portion 33 extending forwardly from the body portion 31, a tail 32 extending vertically and downwardly from the body portion 31 and a hook 321 extending forwardly from the tail 32. The retention portion 34 comprises a barb 341 at one end and a press portion 340 at the other end. The spring portion 33 comprises a contact portion 331 at a free end thereof.

FIGS. 4-12 shows the assemble process of the socket 100 of the present invention, below is the detail description of the assemble process. First, the upper contacts 4 are inserted into the upper passageways 1031 with a certain depth from the back surface 103 of the base 1, the push portions 410 of the upper contacts 4 are located beyond the back surface 103; second, the solder balls 5 are assembled into the recess 1020 corresponding to the upper contacts 4; third, push the push portion 410 of the upper contacts 4 forwardly into the upper passageways 1031 to make the upper contacts 4 positioned in the base 1 securely and the solder balls 5 are hooked by the hook 421 of the upper contacts 4 respectively; then, the lower contacts 3 are inserted into the lower passageways 1022 with a certain depth from the bottom surface 102, the press portion 340 of the lower contacts 3 are located beyond the bottom surface 102; next, the solder balls 5 are assembled into the recess 1020 corresponding to the lower contacts 3; finally, press the press portion 340 of the upper contacts 4 downwardly into lower passageways 1022 to make the lower contacts 3 positioned in the base 1 securely and the solder balls 5 are hooked by the hook 321 of the lower contacts 3 respectively. The solder balls 5 are set to four rows corresponding to the upper contacts 4 and the lower contacts 3, and the solder balls 5 are staggered in different rows.

The solder ball 5 contacts with the base 1 and the upper contact 4 or the lower contact 3 to make it received in the recess 1020 securely, and need not the fuse process, which reduce the cost and are easy to manufacture.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. A socket comprising:

a base comprising a central slot for receiving a module and a plurality of passageways at two sides of the central slot;

a plurality of contacts disposed in the corresponding passageways, respectively, the contacts comprising a body portion positioned in the base, a contact portion extending from the body portion into the central slot, a tail extending from the body portion; and a plurality of solder balls assembled to the base and positioned by the tails of the contacts;

wherein the passageway comprises an upper passageway and a lower passageway located at two sides of the central slot, the contact comprises an upper contact located in the upper passageway and a lower contact positioned in the lower passageway;

wherein the base includes a main body and a pair of latches extending from opposite ends of the main body;

wherein the main body comprises an upper surface, a bottom surface opposite to the upper surface, a back surface connecting the upper surface and the bottom surface and a front surface opposite to the back surface;

wherein the upper passageways penetrate from the back surface to the central slot, and the lower passageways penetrate from one of the front surface and the bottom surface to the slot;

wherein the upper contact comprises a push portion near the back surface and the lower contact comprises a press portion near one of the front surface and the bottom surface so that the upper contacts are inserted into the upper passageways by pushing the push portion into the upper passageways and the lower contacts are inserted into the lower passageways by pressing the press portion into the lower passageways;

wherein the base comprises a plurality of recesses recessed from the bottom surface to the body and communicated with a corresponding passageways, and the solder balls each locates in a recess.

2. The socket as claimed in claim 1, wherein the contact comprises a hook extending forwardly from the tail to support the solder ball.

3. The socket as claimed in claim 1, wherein the solder ball connects with the base and the upper contact or the lower contact to make the solder ball received in the recess securely.

4. The socket as claimed in claim 1, wherein the recesses are set to four rows corresponding to the upper passageways and the lower passageways, and are staggered in different rows.

5. A method of making the socket comprising:

(a) providing a base with a bottom surface, a back surface and a front surface connecting the bottom surface, the base comprising a central slot recessed from the front surface, a plurality of upper passageways and lower passageways at two sides of the central slot and a plurality of recess recessed from the bottom surface;

(b) providing a plurality of solder balls being assembled to the recesses, respectively; and (c) providing a plurality of upper contacts and a plurality of lower contacts each with a tail, the upper contacts are assembled into the upper passageways from the back surface of the base, the lower contacts are assembled to the lower passageways from one of the front surface and the bottom surface of the base, the solder balls are positioned by the tails of the upper contacts and the lower contacts;

wherein the upper contacts and the lower contacts each comprises a hook extending from the tail to support the solder ball;

wherein the upper passageways penetrate from the back surface to the central slot, and the lower passageways penetrate from one of the front surface and the bottom surface to the central slot;

wherein the upper contact comprises a push portion near the back surface and the lower contact comprises a press portion near one of the front surface and the bottom surface so that the upper contact are inserted into the upper passageways by pushing the push portion into the upper passageways and the lower contacts are inserted into the lower passageways by pressing the press portion into the lower passageways;

wherein the solder balls are retained in the recesses by the hooks of the corresponding contacts only after the contacts are fully inserted into the corresponding passageways.

6. The method as claimed in claim 5, wherein the push portion of the upper contact is located beyond the back surface before the solder ball being assembled to the recess, and then push the push portion forwardly to make the tail to position the solder ball.

7. The method as claimed in claim 5, wherein the press portion of the lower contact is located beyond the bottom surface before the solder ball being assembled to the recess, and then press the press portion downwardly to make the tail to position the solder ball.

8. An electrical connector assembly for use with a memory module having first conductive pads thereon and a printed circuit board having second conductive pads thereon, comprising:

an insulative housing defining mating and mounting faces;

a plurality of passageways in a slit form, formed in the housing and extending between the mating face and the mounting face;

a plurality of recesses formed in the mounting face and intimately and communicatively beside the corresponding passageways, respectively;

a plurality of contacts disposed in the corresponding passageways, respectively, each of said contacts defining a contacting section around the mating face, and a mounting section around the mounting face;

a plurality of solder balls disposed in the corresponding recesses, respectively; wherein each of the contacts is formed by stamping and defines thereof a thickness direction along which not only a contacting area of the contacting section for connecting to the first corresponding conducive pad of the memory module but also a clipping area of the mounting section for holding the corresponding solder ball in the recess are formed so as to facilitate soldering the mounting section to the corresponding second conductive pad in a later time;

wherein each of said mounting sections define a hook structure grasping the corresponding solder ball;

wherein the contacts are categorized with upper ones and lower ones, and the passageways are categorized with upper ones and lower ones under condition that the upper contacts are configured to be inserted into the corresponding upper passageways in a forward direction while the lower contacts are configured to be inserted into the corresponding lower passageways in one of a rearward direction and an upward direction;

wherein the recesses are communicative with the corresponding upper and lower passageways in a front-to-back direction so that the upper and lower contacts are inserted into the corresponding upper and lower passageways from an initial stage where the solder balls are not securely retained in the recesses to a final stage where the solder balls are securely retained in the recesses.

* * * * *